US009293275B2

(12) United States Patent
Baek

(10) Patent No.: US 9,293,275 B2
(45) Date of Patent: Mar. 22, 2016

(54) MOLDED-CASE CIRCUIT BREAKER

(71) Applicant: LSIS CO., LTD., Anyang-si, Gyeonggi-do (KR)

(72) Inventor: Ki Ho Baek, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 35 days.

(21) Appl. No.: 14/357,510

(22) PCT Filed: Nov. 12, 2012

(86) PCT No.: PCT/KR2012/009523

§ 371 (c)(1),
(2) Date: May 9, 2014

(87) PCT Pub. No.: WO2013/070046

PCT Pub. Date: May 16, 2013

(65) Prior Publication Data

US 2014/0339198 A1 Nov. 20, 2014

(30) Foreign Application Priority Data

Nov. 10, 2011 (KR) ..... 10-2011-0117013

(51) Int. Cl.
*H01H 23/00* (2006.01)
*H01H 9/02* (2006.01)
(Continued)

(52) U.S. Cl.
CPC . *H01H 9/02* (2013.01); *H01H 3/38* (2013.01); *H01H 3/46* (2013.01); *H01H 71/10* (2013.01);
(Continued)

(58) Field of Classification Search
CPC ..... H01H 71/025; H01H 71/2472; H01H 71/525; H01H 73/04; H01H 3/38; H01H 71/10; H01H 71/12; H01H 3/46; H01H 73/02; H01H 73/06; H01H 9/02; H01H 71/503; H01H 71/52; H01H 71/526; H01H 73/045; H01H 83/20
USPC ..... 200/401, 400, 244; 335/172, 147, 15, 335/16, 190, 195; 218/22
See application file for complete search history.

(56) References Cited

U.S. PATENT DOCUMENTS 4,321,440 A 3/1982 Fujiwara et al.
5,023,416 A * 6/1991 Oyama et al. ..... 200/244
(Continued)

FOREIGN PATENT DOCUMENTS

CN 86107135 4/1987
CN 101071701 11/2007
(Continued)

OTHER PUBLICATIONS
Japan Patent Office Application Serial No. 2014-540958, Office Action dated Mar. 2, 2015, 4 pages.
(Continued)

*Primary Examiner* — Kyung Lee
(74) *Attorney, Agent, or Firm* — Lee, Hong, Degerman, Kang & Waimey

(57) ABSTRACT

Provided is a molded case circuit breaker including an upper external box defining a rear space, a lower external box coupled with the upper external box and defining a front space divided from the rear space together with the upper external box, a fixed contact unit provided on one side of the front space and connected to electrically connected to one of a power supply and a load, a movable contact unit installed in the front space to be movable and being in contact with the fixed contact unit or being separated from the fixed contact unit, a switching device installed in the rear space and operating to allow the movable contact unit to be in contact with the fixed contact unit or to be separated from the fixed contact unit, an operation device installed in the front space and the rear space and transferring the movable contact unit according to operation of the switching device, and an electrode shaft installed on one side of the upper external box, corresponding to an outside of the front space.

12 Claims, 7 Drawing Sheets

(51) Int. Cl.

| | |
|---|---|
| ***H01H 71/10*** | (2006.01) |
| ***H01H 73/02*** | (2006.01) |
| ***H01H 3/38*** | (2006.01) |
| ***H01H 3/46*** | (2006.01) |
| ***H01H 71/12*** | (2006.01) |
| ***H01H 73/06*** | (2006.01) |

(52) U.S. Cl.

CPC ..... *H01H 71/12* (2013.01); *H01H 73/02* (2013.01); *H01H 73/06* (2013.01); *H01H 2009/0285* (2013.01)

(56) References Cited

U.S. PATENT DOCUMENTS

| | | | | |
|---|---|---|---|---|
| 5,200,724 | A * | 4/1993 | Gula et al. | 335/166 |
| 6,747,534 | B1 * | 6/2004 | Mueller et al. | 335/38 |
| 7,482,901 | B2 * | 1/2009 | Watanabe et al. | 335/201 |
| 7,683,276 | B2 | 3/2010 | Weister et al. | |
| 8,158,898 | B2 * | 4/2012 | Park | 200/244 |
| 2008/0088093 | A1 | 4/2008 | Weister et al. | |

FOREIGN PATENT DOCUMENTS

| | | |
|---|---|---|
| CN | 102044385 | 5/2011 |
| EP | 2028671 | 2/2009 |
| EP | 2315228 | 4/2011 |
| EP | 2348519 | 7/2011 |
| JP | 2-69446 | 5/1990 |
| JP | 02-291634 | 12/1990 |
| JP | 2006073200 | 3/2006 |
| JP | 2007-305409 | 11/2007 |
| JP | 2010-097624 | 4/2010 |
| JP | 2011-091042 | 5/2011 |
| JP | 2011-151023 | 8/2011 |
| KR | 1020110044622 | 4/2011 |
| WO | 99/56296 | 11/1999 |

OTHER PUBLICATIONS

PCT International Application No. PCT/KR2012/009523, International Search Report dated Feb. 8, 2013, 1 page.

European Patent Office Application U.S. Appl. No. 12848172.8, Search Report dated Jul. 10, 2015, 7 pages.

The State Intellectual Property Office of the People's Republic of China Application Serial No. 201280066469.4, Office Action dated Jul. 31, 2015, 6 pages.

* cited by examiner

MOLDED-CASE CIRCUIT BREAKER

CROSS-REFERENCE TO RELATED APPLICATIONS

This application is the National Stage filing under 35 U.S.C. 371 of International Application No. PCT/KR2012/009523, filed on Nov. 12, 2012, which claims the benefit of earlier filing date and right of priority to Korean Patent Application No. 10-2011-0117013, filed on Nov. 10, 2011, the contents of which are all hereby incorporated by reference herein in their entirety.

TECHNICAL FIELD

The present invention relates to a molded case circuit breaker.

BACKGROUND ART

Molded case circuit breakers, when an abnormal current such as an over current and a short-circuit current is applied to a circuit, protect the circuit by breaking the circuit. In molded case circuit breakers described above, it is necessary to interrupt an arc induced at an opening time that a fixed contact point and a movable contact point are separated from each other when breaking the circuit.

FIG. 1 illustrates a general molded case circuit breaker disclosed in Korean Patent Publication No. 2001-0043240.

Referring to FIG. 1, in general, a front compartment 12 and a rear compartment mutually divided from each other are located in a molded case circuit breaker 10. Also, a fixed contact point 60 and a movable contact point 61 are located in the front compartment 12 and a driving device for transferring the movable contact point 61, and particularly, an electrode shaft 78 is located in the rear compartment 14. In the general molded case circuit breaker 10 configured as described above, the electrode shaft 78 prevents transfer of an arc from the front compartment 12, to which the arc is actually induced, to the rear compartment 14. Also, the induced arc is transferred to an arc extinguishing chamber 58 located in front thereof.

However, the general molded case circuit breaker has limitations as follows.

Generally, the electrode shaft 78 is located inside the rear compartment 14. However, the rear compartment 14 has to additionally have a certain space, that is, a height to allow the driving device to operate. Accordingly, a height of the molded case circuit breaker 10 substantially increases.

Also, in general, as described above, the height of the molded case circuit breaker 10 substantially increases. Accordingly, while the fixed contact point 60 is being separated from the movable contact point 61, a floating arc is transferred to a rear end of the front compartment 12 and the rear compartment 14, thereby causing damage in the driving device.

DISCLOSURE OF THE INVENTION

Technical Problem

The present invention provides a molded case circuit breaker capable of efficiently preventing transfer of an arc.

The present invention also provides a molded case circuit breaker capable of preventing a phenomenon, in which a size of a product increases to prevent transfer of an arc.

Technical Solution

According to an embodiment of the present invention, there is provided a molded case circuit breaker including an upper external box defining a rear space, a lower external box coupled with the upper external box and defining a front space divided from the rear space together with the upper external box, a fixed contact unit provided on one side of the front space and connected to electrically connected to one of a power supply and a load, a movable contact unit installed in the front space to be movable and being in contact with the fixed contact unit or being separated from the fixed contact unit, a switching device installed in the rear space and operating to allow the movable contact unit to be in contact with the fixed contact unit or to be separated from the fixed contact unit, an operation device installed in the front space and the rear space and transferring the movable contact unit according to operation of the switching device, and an electrode shaft installed on one side of the upper external box, corresponding to an outside of the front space, in which the operation device includes a first link element including an upper link connected to the switching device and a lower link connected to the upper link, a second link element installed to be pivotable around the electrode shaft, one side of the second link element being connected to another side of the lower link to be pivotable, and a third link element with one side connected to another side of the second link element to be pivotable and another side connected to the movable contact unit to be pivotable.

Advantageous Effects

According to an embodiment of the present invention, an electrode shaft is installed outside a front space and a rear space, thereby substantially reducing a height of a product or preventing an increase in size of the product. Accordingly, not only the size of the product is reduced but also a size of a space, to which an arc is substantially transferred, is reduced, thereby preventing the transfer of the arc.

Also, in the embodiment, a phenomenon of transferring an arc occurring at an opening time of a fixed contact point and a movable contact point due to a barrier projection and a barrier member to the rear space may be efficiently prevented. Accordingly, in the embodiment, damage in a component caused by the arc induced at the opening time of the fixed contact point and the movable contact point may be minimized.

Mode for Carrying Out the Invention

Hereinafter, an embodiment of the present invention will be described in detail with reference to the attached drawings.

Figure 1:
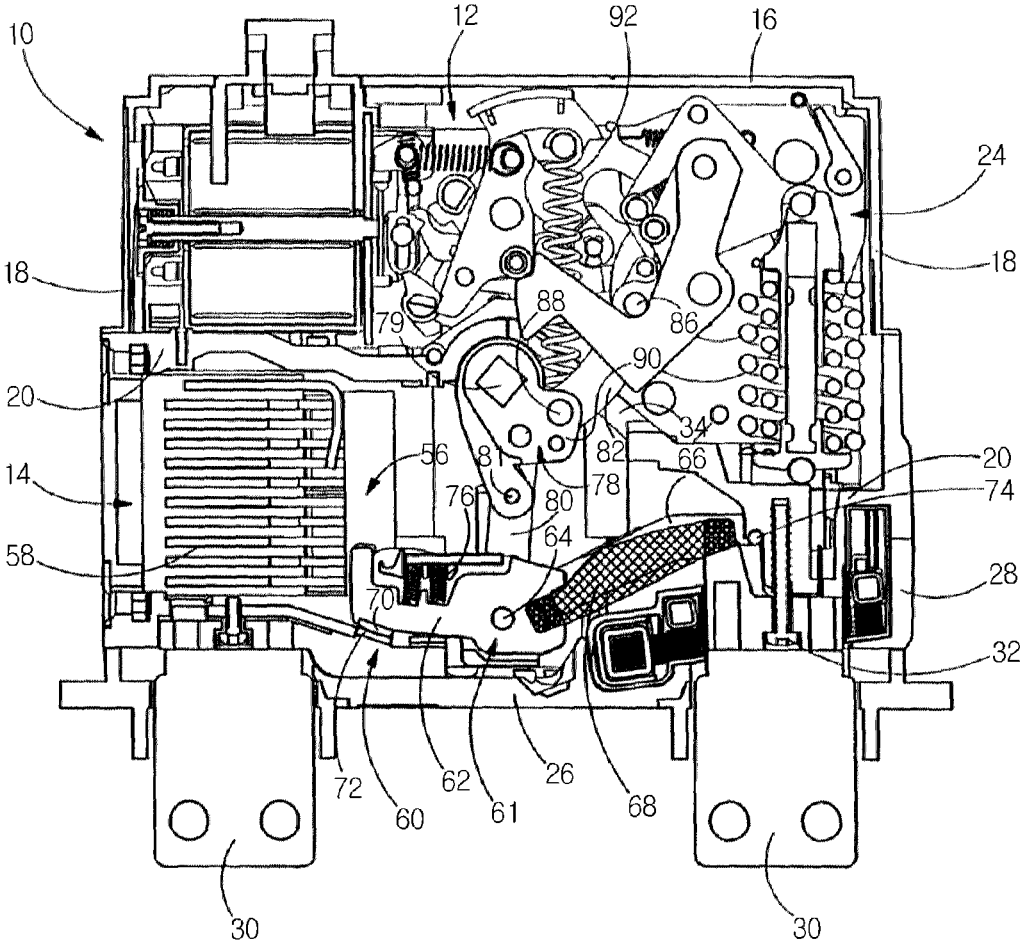
FIG. 1 is a cross-section view of a general molded case circuit breaker.
Figure 2:
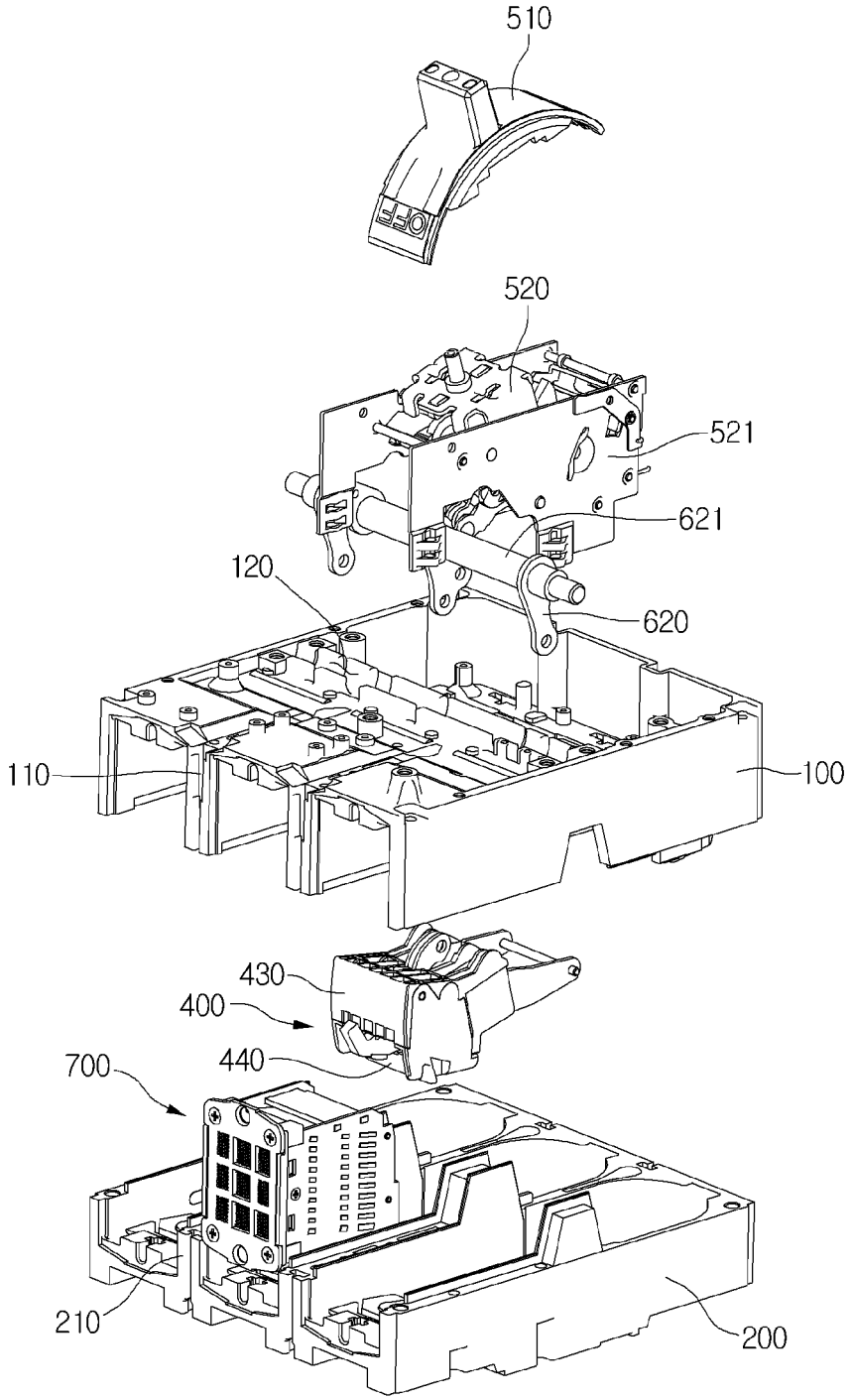
FIG. 2 is an exploded perspective view of a molded case circuit breaker according to an embodiment of the present invention.
Figure 3:
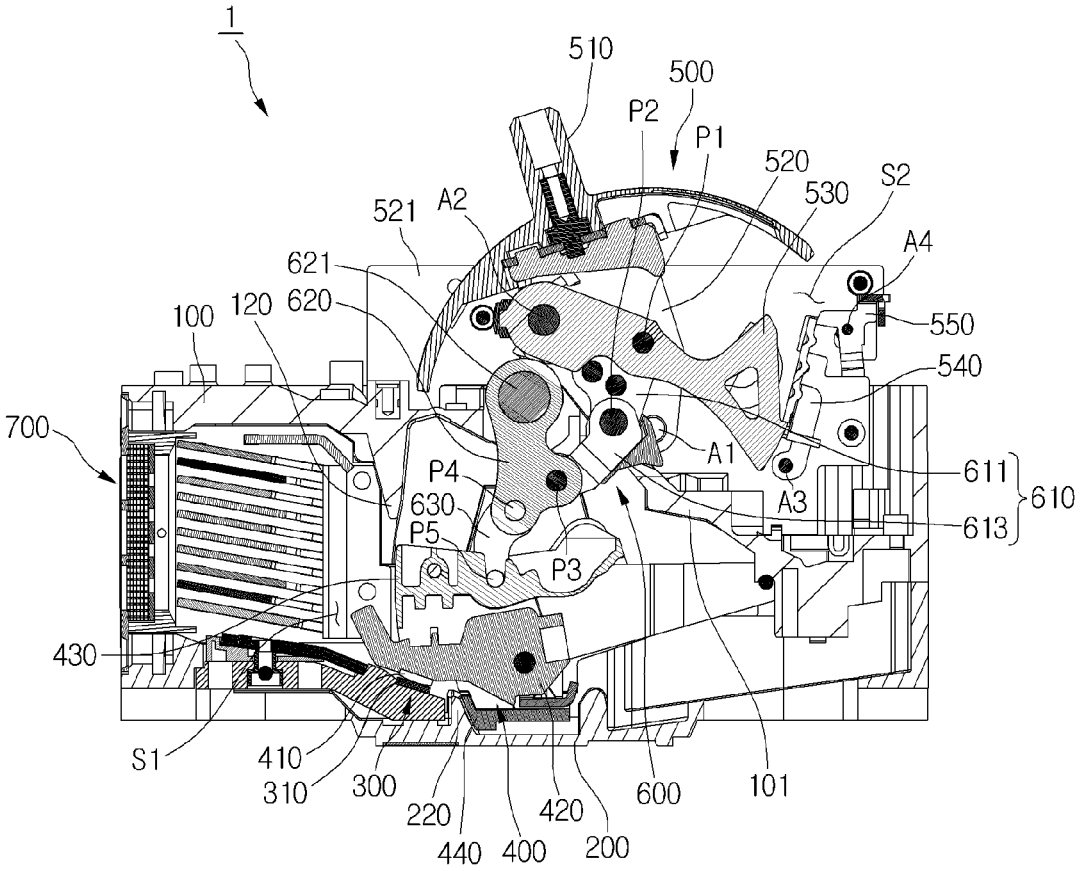
FIG. 3 is a cross-sectional view illustrating a closed state according to an embodiment of the present invention.
Figure 4:
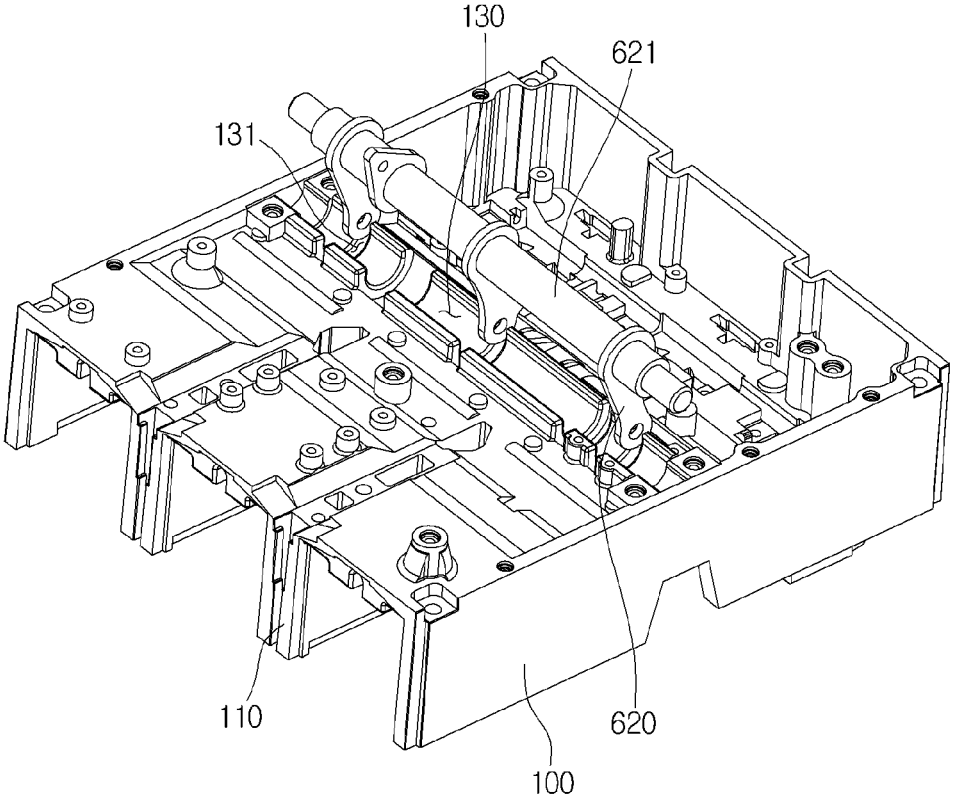
FIG. 4 is an exploded perspective view a main part according to an embodiment of the present invention.

FIG. 2 is an exploded perspective view of a molded case circuit breaker 1 according to an embodiment of the present invention, FIG. 3 is a cross-sectional view illustrating a closed state according to an embodiment of the present invention, and FIG. 4 is an exploded perspective view a main part according to an embodiment of the present invention.

Referring to FIGS. 2 to 4, an external shape of the molded case circuit breaker 1 is formed of an upper external box 100 and a lower external box 200. Also, the upper external box 100 and the lower external box 200 are coupled with each other, thereby defining an installation space installed with all sorts of components forming the circuit breaker 1. For example, the upper external box 100 may be formed as a polyhedral shape with open bottom and front. Also, the lower external box 200 may be formed as a polyhedral shape with open top and front. However, the shapes of the upper external box 100 and the lower external box 200 are not limited thereto and may be formed as to be coupled with each other.

The upper external box 100 includes an intermediate partition 101. For example, a part of the top of the upper external box 100 may be dent downwards, thereby forming the intermediate partition 101. Also, when the upper external box 100 and the lower external box 200 are coupled with each other, based on the intermediate partition 101, a lower space thereof is defined as a front space S1 and an upper space thereof is defined as a rear space S2.

Also, the front space S1 is divided into a plurality of spaces according to a number of poles.

In other words, in case of a molded case circuit breaker for three poles of R, S, and T, the front space S1 is divided into three spaces. In case of a molded case circuit breaker for four poles of R, S, T, and N, the front space S1 is divided into four spaces. The front space S1 may be divided by an upper sidewall 110 provided on the upper external box 100 and a lower sidewall 210 provided on the lower external box 200.

Also, the upper external box 100 and the lower external box 200 are provided with an upper barrier projection 120 and a lower barrier projection 220, respectively. A part of the upper external box 100, defining a ceiling surface of the front space S1, is extended downwards, thereby forming the upper barrier projection 120. Also, a part of the lower external box 100, defining a bottom surface of the front space S1, is extended upwards, thereby forming the lower barrier projection 220. Also, a bottom end of the upper barrier projection 120 and a top end of the lower barrier projection 220 are spaced from each other. Accordingly, substantially, the upper barrier projection 120 and the lower barrier projection 220 may partially divide the front space S1 into a space for allowing an operation device 600 that will be described later to be located therein and a region for allowing an arc extinguishment chamber 700 to be located therein.

On the other hand, the upper external box 100 is formed with a shaft mounting groove 130. The shaft mounting groove 130 is a plate to be mounted with an electrode shaft 621 that will be described later. Substantially, a part of the upper external box 100, defining the front space S1, is dent downwards, thereby forming the shaft mounting groove 130.

Also, the shaft mounting groove 130 is formed with a plurality of link penetration slot 131. The link penetration slot 131 is formed by cutting a part of the shaft mounting groove 130. The link penetration slot 131 is a place penetrated with a second link element 620 that will be described later.

The front space S1 is provided with a fixed contact unit 300 and a movable contact unit 400. The fixed contact unit 300 and the movable contact unit 400 are in contact with each other to close the circuit or are separated from each other to open the circuit.

In more detail, the fixed contact unit 300 includes a fixed pad 310. The fixed pad 310 is fixed to one side of the lower external box 200 corresponding to the bottom surface of the front space S1.

Also, the movable contact unit 400 includes a contact pad 410 and a movable portion 420. The contact pad 410 is fixed to the movable portion 420 and is in selective contact with the fixed pad 310. The movable portion 420 is operated by the operation device 600 and moves along a certain way to allow the contact pad 410 to be in selective contact with the fixed pad 310 or to be separate therefrom. Hereinafter, for convenience of description, when the fixed pad 310 and the contact pad 410 are in contact with each other, a position of the movable portion 420 is designated as a circuit opening position (refer to FIG. 3) and positions of the fixed pad 310 and the contact pad 410, perfectly separate from a preset insulating distance, are designated as a circuit breaking position (refer to FIGS. 5 and 7). Accordingly, the movable portion 420 may move between the circuit opening position and the circuit breaking position along a certain way. Also, the movable portion 420 is in contact with one side of the upper barrier projection 120 while being located in the circuit opening position. Although not shown in the drawing, the movable contact unit 400 includes an electrode spring. The electrode spring gives the movable portion 420 elastic force in a direction allowing the fixed contact unit 300 and the movable contact unit 400 to be separate from each other, that is, in a direction allowing the fixed pad 310 and the contact pad 410 to be separate from each other.

The movable contact unit 400 includes an upper barrier element 430 and a lower barrier element 440. The upper barrier element 430 and the lower barrier element 440 are located on top and bottom of the movable portion 420, respectively. For example, the upper barrier element 430 and the lower barrier element 440 may be fixed to the movable portion 420, respectively. Also, the upper barrier element 430 and the lower barrier element 440 may be fixed to each other and the movable portion 420 may be located therebetween. Merely, the upper barrier element 430 and the lower barrier element 440 may move together with the movable contact unit 400, that is, the movable portion 420.

In more detail, the upper barrier element 430 and the lower barrier element 440 prevent a phenomenon of transferring an arc generated at an opening time, in which the fixed contact unit 300 and the movable contact unit 400 are separated from each other, to the rear of the upper and lower barrier projections 120 and 220. Substantially, in any one position of a movement way of the movable contact unit 400 between the circuit opening position and the circuit breaking position, (hereinafter, for convenience of description, referred to as an opening position), the upper barrier element 430 shield a space between the upper barrier projection 120 and the movable portion 420. Also, while the movable contact unit 400 is being located in the opening position, the lower barrier element 440 shields a space between the lower barrier projection 220 and the movable portion 420. Also, while the movable contact unit 400 is being located in the opening position, a top end of the upper barrier element 430 may be located adjacently to a bottom end of the upper barrier projection 120 and a bottom end of the lower barrier element 440 may be located adjacently to a top end of the lower barrier projection 220. As another example, while the movable contact unit 400 is being located in the opening position, a part of the top end of the upper barrier element 430 may be overlapped forwards and backwards with a part of the bottom end of the upper barrier projection 120 and a part of the bottom end of the lower barrier element 440 may be overlapped forwards and backwards with a part of the top end of the lower barrier projection 220. Accordingly, the upper and lower barrier projections 120 and 220 and the upper and lower barrier element 430 and 440 may be designated as barriers selectively opening and closing top and bottom spaces of the movable contact unit 400.

That is, the upper barrier projection 120 and the upper barrier element 430 may be barriers selectively opening and closing the top space of the movable contact unit 400 and the lower barrier projection 220 and the lower barrier element 440 may be barriers selectively opening and closing the bottom space of the movable contact unit 400.

Merely, shapes and sizes of the upper and lower barrier projections 120 and 220 and the upper and lower barrier elements 430 and 440 are determined within a range not interfering movement of the movable portion 420. That is, when the movable portion 420 is located in any one of the opening positions, the upper and lower barrier projections 120 and 220 and the upper and lower barrier elements 430 and 440 are not allowed to be in contact with each other. In other words, according to movement of the movable portion 420, the upper and lower barrier projections 120 and 220 are located outside a way formed by the upper and lower barrier elements 430 and 440.

The molded case circuit breaker 1 includes a switching device 500. The switching device 500 provides driving force for allowing the circuit to be open or closed according to operation of a user, that is, for allowing the fixed contact unit 300 and the movable contact unit 400 to be in contact with each other or to be separate from each other. The switching device 500 includes a handle 510, a lever 520, a trip spring (not shown), a latch 530, a latch holder 540, and a nail 550.

The handle 510 is for allowing the user to manually open or close the circuit. The handle 510 is installed on a top surface of the upper external box 100 to be pivotable along a certain way based on a handle shaft A1 that will be described later. For example, when the handle 510 is located as shown in FIG. 3, the circuit is open. Also, the handle 510 is located as shown in one of FIGS. 5 and 7, the circuit is broken.

Hereinafter, positions of the handle 510 shown in FIGS. 3, 5, and 7 will be designated as a circuit opening position, a circuit breaking position, and a trip breaking position, respectively.

The lever 520 is fixed to the handle 510 and is extended into the rear space S2. The lever 520 is connected to the handle shaft A1 that becomes a pivoting center of the handle 510.

The trip spring gives elastic force, that is, tensile force to allow the handle 510 to pivot to the circuit opening position or the circuit breaking position based on a certain position of the pivoting way of the handle 510. One end of the trip spring is supported by the handle 510 or the lever 520. Also, another end of the trip spring is supported by a first link element 610 that will be described later.

The latch 530 restricts the trip spring to charge elastic energy of the trip spring or releases the trip spring to discharge the elastic energy. For this, the latch 530 is installed in the rear space S2 to pivot around a latch shaft A2.

The latch holder 540 selectively restricts pivoting of the latch 530. The latch holder 540 is installed to pivot around a holder shaft A3 inside the rear space S2. For example, when the latch holder 540 is located as shown in FIG. 3, the pivoting of the latch 530 is restricted. Also, when the latch holder 540 is located as shown in FIG. 7, the pivoting of the latch 530 is allowed. The latch holder 540 receives elastic force from a latch spring (not shown) to pivot in a direction for restricting the pivoting of the latch 530.

The nail 550 has the latch holder 540 pivot in a direction for allowing the pivoting of the latch 530. Substantially, the nail 550 pivots around a nail shaft A4 due to a trip inspection device (not shown). The trip inspection device, for example, is operated by electromagnetic attractive force when an abnormal current occurs in the circuit and has the nail 550 pivot. Since a configuration of the trip inspection device as described above is already well known and there is no relation with the features of the present invention, a detailed description will be omitted.

The molded case circuit breaker 1 includes the operation device 600. The operation device 600, according to operation of the switching device 500, is allowed to be selectively in contact with or separate from the fixed contact unit 300 and the movable contact unit 400. The operation device 600 includes first to third link elements 610, 620, and 630.

In more detail, the first link element 610 includes an upper link 611 and a lower link 613. One side of the upper link 611 is connected to the switching device 500 by a connecting pin P1 to be pivotable. In more detail, the upper link 611 is connected to the latch 530 to be pivotable. Also, one side of the lower link 613 is connected to another side of the upper link 611 by a connecting pin P2. Another end of the trip spring is supported by a connection shaft between the upper link 611 and the lower link 613.

The second link element 620 is installed to pivot around the electrode shaft 621. Substantially, the second link element 620 may be additionally manufactured and fixed to the electrode shaft 621 by welding or may be molded together with the electrode shaft 621 as a single body. Also, when the electrode shaft 621 is mounted on the shaft mounting groove 130, the second link element 620 penetrates the link penetration slot 131 and is located inside the rear space S2. Also, one side of the second link element 620 is connected to the lower link 613 by a connecting pin P3 to be pivotable.

One side of the third link element 630 is connected to another side of the second link element 620 by a connecting pin P4 to be pivotable. Also, another side of the third link element 630 is connected to the movable contact unit 400 by a connecting pin P5 to be pivotable. For example, the third link element 630 may be connected to the upper barrier element 430 to be pivotable.

Accordingly, the movable contact unit 400 is capable of revolving around the connecting pin P4 connecting the third link element 630 to the second link element 620 to be pivotable and is capable of rotating around the connecting pin P5 connecting the third link element 630 to the movable contact unit 400.

Also, the arc extinguishment chamber 700 is located inside the front space S1 corresponding to the front of the fixed contact unit 300. The arc extinguishment chamber 700 extinguishes an arc induced when the fixed contact unit 300 and the movable contact unit 400 are separated.

Hereinafter, the operation of the circuit breaker according to the embodiment of the present invention will be described in detail with reference to the attached drawings.

Figure 5:
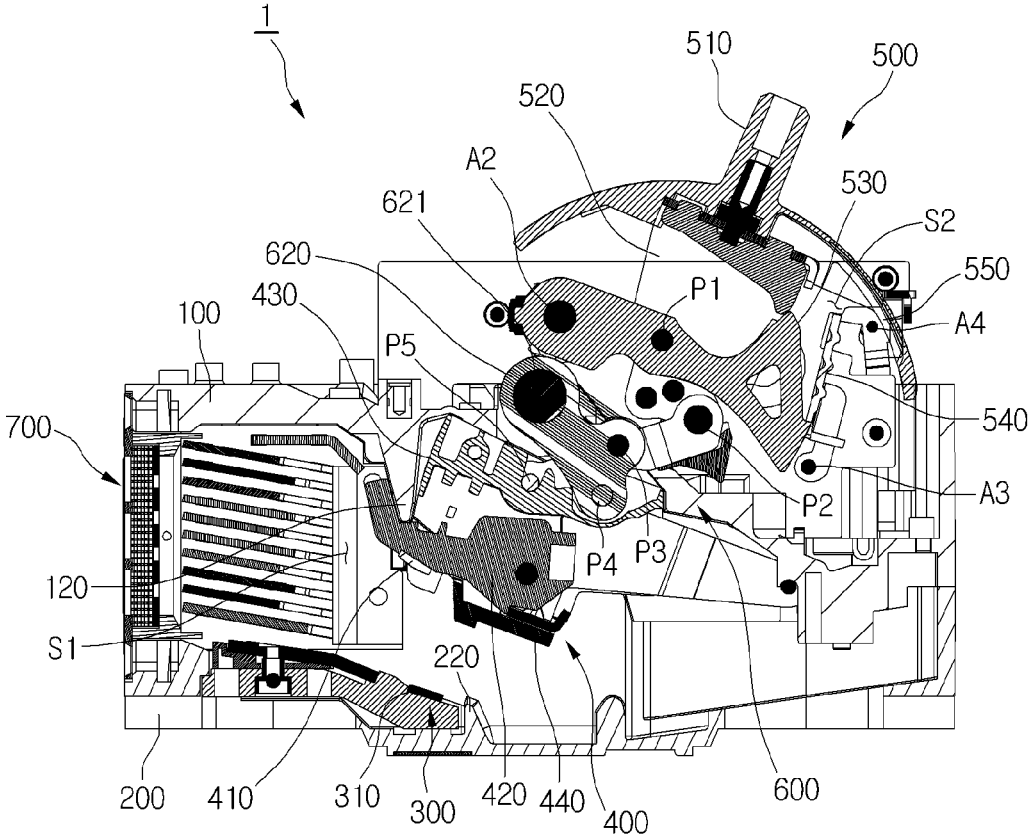
FIG. 5 is a cross-sectional view illustrating a manually broken state.
Figure 6:
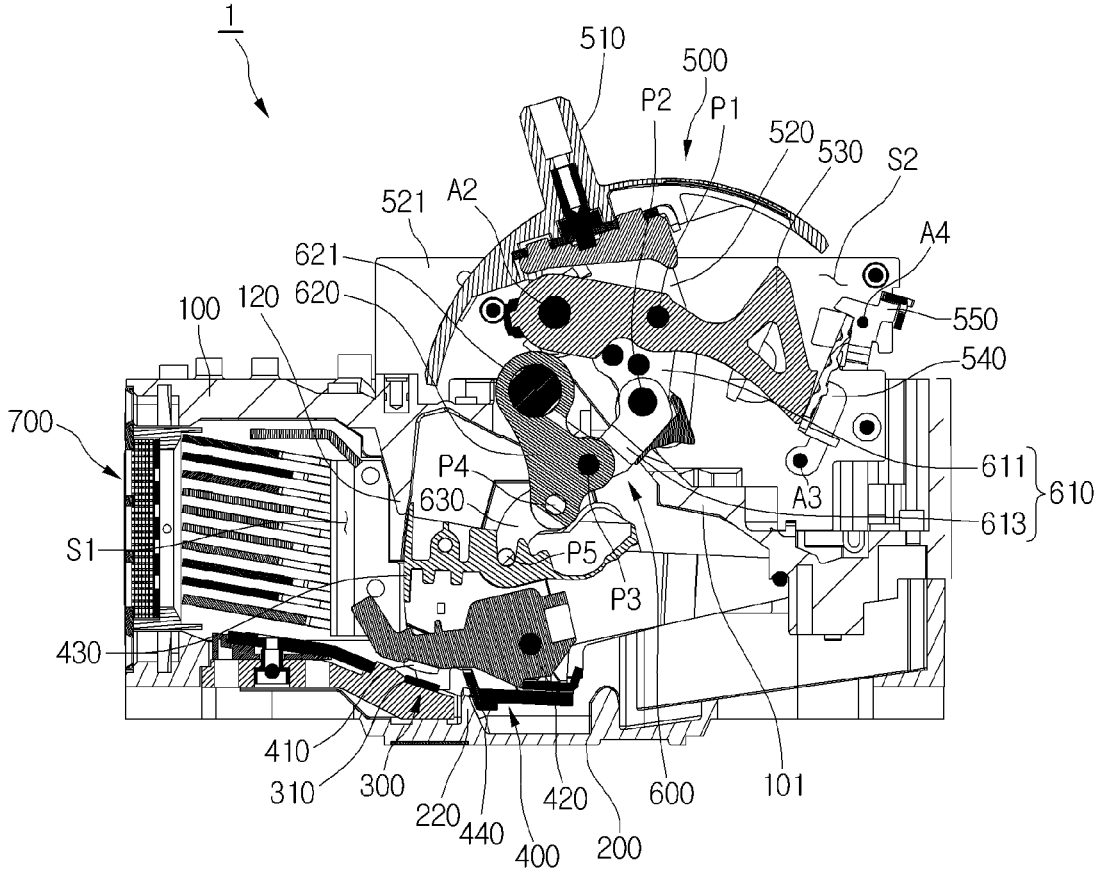
FIGS. 6 and 7 are cross-sectional views illustrating a process of breaking a trip according to an embodiment of the present invention.
Figure 7:
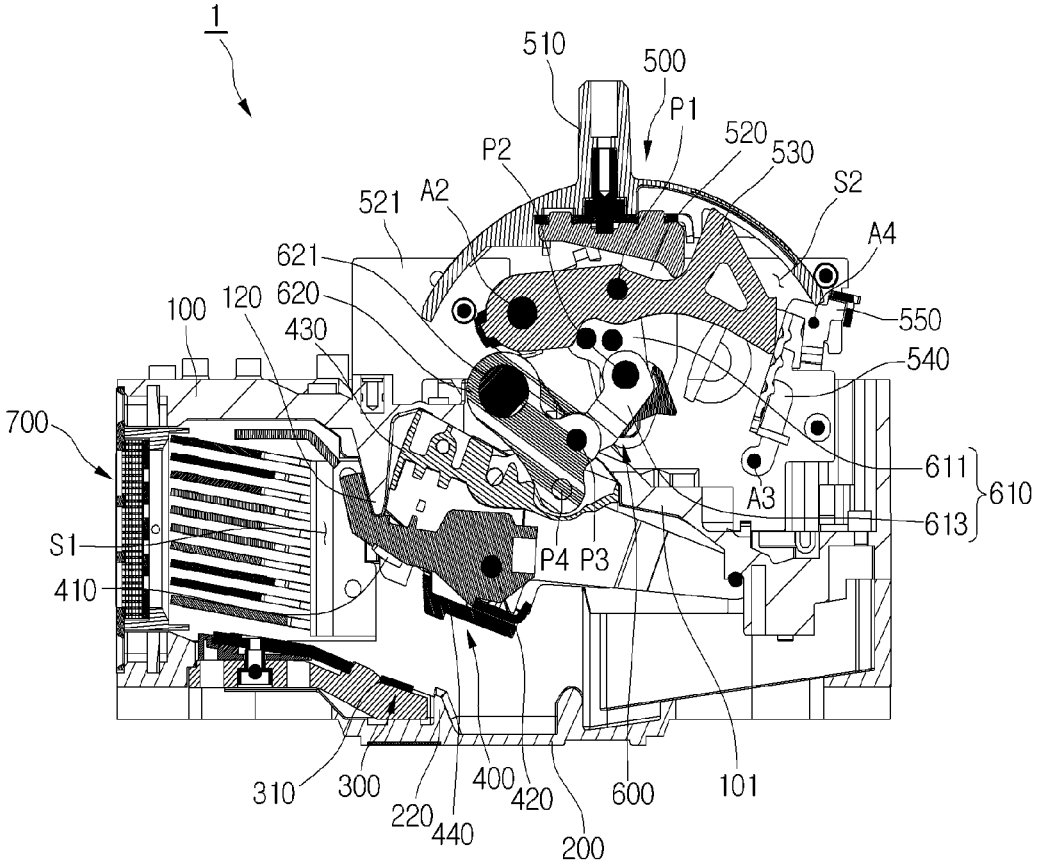

FIG. 5 is a cross-sectional view illustrating a manually broken state according to the embodiment of the present invention, and FIGS. 6 and 7 are cross-sectional views illustrating a process of breaking a trip according to the embodiment of the present invention.

In order to manually breaking a circuit, a user has the handle 510 pivot from a circuit opening position to a circuit breaking position. However, pivoting of the latch 530 is being restricted by the latch holder 540. Accordingly, when the handle 510 pivots around the handle shaft Al clockwise in the drawing, the latch 530 does not pivot. Also, when the handle 510 pivots, as shown in FIG. 5, the first to third link elements 610, 620, and 530 pivot around the respective connecting pins P1, P2, P3, and P4 in a certain direction due to elastic forces of the trip spring and the electrode spring. In more detail, the upper link 611 of the first link element 610 pivots around the connecting pin P1 counterclockwise, and being interlocked with this, the lower link 613 pivots around the connecting pin P2 clockwise. Also, the second link element 620 connected to the lower link 613 by the connecting pin P3 pivots around the electrode shaft 621 counterclockwise, and being interlocked with this, the third link element 630 pivots around the connecting pin P4.

Being interlocked with pivoting of the third link element 630, the movable contact unit 400 connected to the third link element 630 to be pivotable pivots around the connecting pin P5 counterclockwise and ascends. Accordingly, the movable contact unit 400 is separated from the fixed contact unit 300. That is, the fixed pad 310 and the contact pad 410 are separate from each other and opening starts.

On the other hand, an arch is induced at an opening time when the fixed pad 310 and the contact pad 410 are separated from each other. In the embodiment, the arc induced as described above is not transferred to a rear end of the front space S1 installed with the switching device 500 and the operation device 600 and is transferred to a front end of the front space S1 installed with the arc extinguishment chamber 700. It will be described in detail in a description for a trip breaking process.

On the other hand, when an abnormal current such as a trip current flows and a trip is broken, as shown in FIG. 6, the nail 550 pivots due to the trip inspection device, thereby allowing the latch 530 restricted by the latch holder 540 to pivot. Accordingly, the latch 530 pivots around the latch shaft A2 counterclockwise due to elastic force of the trip spring, and being interlocked with this, the first to third link elements 610, 620, and 630 pivot around the connecting pins P1, P2, P3, and P4 and the movable contact unit 400 is separated from the fixed contact unit 300, thereby initiating opening, in which the contact pad 410 is separated from the fixed pad 310.

However, in the embodiment, the electrode shaft 621 is installed on the shaft mounting groove 130 formed on the outside of the front space S1, that is, a top surface of the upper external box 100. Accordingly, substantially, a height of the molded case circuit breaker 1, that is, a height of the front space S1 is relatively more reduced, thereby reducing a size of a product. Also, the height of the front space S1 is reduced as described above, thereby relatively more reducing a space, to which an arc induced at a point in time when the fixed contact unit 300 and the movable contact unit 400, that is, substantially, the fixed pad 310 and the contact pad 410 are separated from each other.

Also, in the embodiment, transferring the arc induced at the point in time when the fixed pad 310 and the contact pad 410 are separated from each other is prevented by the upper and lower barrier projections 120 and 220 and the upper and lower barrier elements 430 and 440. In more detail, as shown in FIG. 6, in an opening position, in which the fixed pad 310 is separated from the contact pad 410, the upper and lower barrier elements 430 and 440 shield a space between the movable contact unit 400, substantially, the movable portion 420 and the upper and lower barrier projections 120 and 220, respectively. Accordingly, it is possible to prevent a phenomenon, in which the arc induced while the fixed pad 310 is being separated from the contact pad 410 is transferred to the right side in FIG. 6. Also, the arc induced while the fixed pad 310 and the contact pad 410 are being separated from each other is guided to the arc extinguishment chamber 700 to be extinguished.

On the other hand, as shown in FIG. 7, when the latch 530 continuously pivots due to elastic force of the trip spring, the movable contact unit 400 is perfectly separated from the fixed contact unit 300 and a preset insulating distance is maintained. Also, the handle 510 is located in a trip breaking position being interlocked with pivoting of the latch 530 due to the elastic force of the trip spring.

While the present invention has been particularly shown and described with reference to exemplary embodiments thereof, it will be understood by those of ordinary skill in the art that various changes in form and details may be made therein without departing from the spirit and scope of the present invention as defined by the following claims.

In the embodiment described above, it has been described that the barrier includes the upper and lower barrier projections and the upper and lower barrier elements. However, according to a shape of the movable portion, the barrier only may include the upper barrier projection and the upper barrier element or only may include the lower barrier projection and the lower barrier element.

The invention claimed is:

1. A molded case circuit breaker comprising:

an upper external box defining a rear space;

a lower external box coupled with the upper external box and defining a front space divided from the rear space together with the upper external box;

a fixed contact unit provided on one side of the front space and connected to electrically connected to one of a power supply and a load;

a movable contact unit installed in the front space to be movable and being in contact with the fixed contact unit or being separated from the fixed contact unit;

a switching device installed in the rear space and operating to allow the movable contact unit to be in contact with the fixed contact unit or to be separated from the fixed contact unit;

an operation device installed in the front space and the rear space and transferring the movable contact unit according to operation of the switching device; and an electrode shaft installed on one side of the upper external box, corresponding to an outside of the front space, wherein the operation device comprises:

a first link element comprising an upper link connected to the switching device and a lower link connected to the upper link;

a second link element installed to be pivotable around the electrode shaft, one side of the second link element being connected to another side of the lower link to be pivotable; and a third link element with one side connected to another side of the second link element to be pivotable and another side connected to the movable contact unit to be pivotable, wherein the upper external box is provided with a shaft mounting groove formed by denting a part of a top surface of the upper external box downwards to allow the electrode shaft to be mounted thereon, and wherein the upper external box is provided with a link penetration slot formed by cutting a part of the shaft mounting groove to allow the second link element fixed to the electrode shaft to penetrate thereinto.

2. The molded case circuit breaker of claim 1, wherein the movable contact unit is capable of revolving around a connecting pin connecting the third link element to the second link element to be pivotable.

3. The molded case circuit breaker of claim 2, wherein the movable contact unit is capable of rotating around a connecting pin connecting the third link element to the movable contact unit.

4. The molded case circuit breaker according to claim 3, wherein the second link element is fixed to the electrode shaft by welding.

5. The molded case circuit breaker according to claim 3, wherein the second link element is formed together with the electrode shaft as a single body.

6. The molded case circuit breaker according to claim 2, wherein the second link element is fixed to the electrode shaft by welding.

7. The molded case circuit breaker according to claim 2, wherein the second link element is formed together with the electrode shaft as a single body.

8. The molded case circuit breaker of claim 1, wherein the front space and the rear space are divided from each other by an intermediate partition formed by denting a part of a top surface of the upper external box, and wherein the electrode shaft is located in the rear space.

9. The molded case circuit breaker according to claim 8, wherein the second link element is fixed to the electrode shaft by welding.

10. The molded case circuit breaker according to claim 8, wherein the second link element is formed together with the electrode shaft as a single body.

11. The molded case circuit breaker according to claim 1, wherein the second link element is fixed to the electrode shaft by welding.

12. The molded case circuit breaker according to claim 1, wherein the second link element is formed together with the electrode shaft as a single body.

* * * * *